US006123117A

United States Patent [19]

Borellini

[11] Patent Number: 6,123,117

[45] Date of Patent: Sep. 26, 2000

[54] WOVEN LABEL WITH A TRANSPARENT MESH FABRIC SUPERPOSED ON ITS IMAGE

[75] Inventor: Pio Borellini, Reggio Emilia, Italy

[73] Assignee: Varcotex S.r.l., Carpi, Italy

[21] Appl. No.: 09/450,674

[22] Filed: Nov. 30, 1999

[51] Int. Cl.[7] ..... D03D 15/00; G09F 19/00

[52] U.S. Cl. ..... 139/420 A; 139/407; 40/615; 442/206

[58] Field of Search ..... 428/32, 37, 918; 442/206–209, 224, 239, 301; 139/407, 408, 409, 420 A; 40/299.01, 661, 677

[56] References Cited

U.S. PATENT DOCUMENTS

| | | | |
|---|---|---|---|
| 4,104,816 | 8/1978 | Pingeton | 40/299 |
| 4,682,433 | 7/1987 | Stilling | 40/615 |
| 5,573,501 | 11/1996 | Ruscito et al. | 602/7 |

*Primary Examiner*—John I Calvert
*Assistant Examiner*—Robert H. Muromoto, Jr.
*Attorney, Agent, or Firm*—Oblon, Spivak, McClelland, Maier & Neustadt, P.C.

[57] ABSTRACT

A composite label at least partly formed from two separate fabrics, on one face of which an image is provided over which the other fabric is positioned, this consisting of a mesh which enables said image to be seen through it from the outside of the label.

3 Claims, 2 Drawing Sheets

WOVEN LABEL WITH A TRANSPARENT MESH FABRIC SUPERPOSED ON ITS IMAGE

BACKGROUND OF THE INVENTION

1. Field of the Invention

This invention relates to a composite label which is at least partly formed from two separate layers of fabric, one face of one of which carries an image or inscription on which the other fabric layer is superposed, this latter being in the form of a mesh with totally or partly transparent yarns to enable the inscription to be seen through the mesh.

2. Description of the Background

Common woven labels are formed by weaving together warp and weft yarns using yarns of different type and colour to form an image or inscription or the like which is very visible on one face of the fabric. Such labels are used in a very large number of fields and embrace the most diverse sectors ranging from clothing, to furnishing, footwear and the like, they increasingly representing an integral part of the product on which they are applied, not only as an element indicative of the manufacturer but also to provide useful information and to perform an important aesthetic function, as is demonstrated by the fact that labels are increasingly applied at the most visible point of the article on which they are used.

The wefts which form the images or inscriptions on the labels use wide weaves, passing above and outside the warp yarns of the fabric.

It follows that the images or inscriptions formed on woven labels of known type are easily subject to damage or deterioration both during their application to the articles which they are required to mark, and during normal use of these articles. In this respect it should be noted that the labels are normally fixed along all or part of their perimeter to the article to which they are to be applied, so that their rear (and hence also the area corresponding to the images) is protected during use, whereas the outer part (ie that on which the image or inscription is visible) is easily damaged.

SUMMARY OF THE INVENTION

The main object of this invention is to provide a woven label having images or inscriptions, of which that surface to be exposed to view is secured to a resistant support fabric which protects the image from any damage deriving from the application of the label to articles to be marked and to wear consequent on prolonged use, while still enabling it to be seen and indeed improving its appearance by original effects of depth and refraction which are not found in known labels.

This and other objects are attained by a composite label at least partly formed from two separate layers of fabric superposed one on the other, of which a first fabric is formed from warp and weft yarns of different colour woven together in such a manner as to form an image or inscription on one face of said first fabric, characterised in that the second fabric is a mesh fabric at least partially formed from transparent yarns and superposed on at least said image of the first fabric.

The mesh fabric can cover just the image or inscription present on one face of the first fabric, or can cover the entire face of said fabric. It can also be formed totally or only partially of yarns of traditional type, it being in any event essential that the image formed within the composite label between the two layers of fabric be visible through the mesh fabric.

The composite labels of the invention can be easily produced on jacquard looms (of gripper, sickle or air type with jacquard command and template for beating the weft) of modern design, and can be divided into two large categories, namely labels with selvedged edges and labels with their edges cut and welded together thermally or by ultrasound.

BRIEF DESCRIPTION OF THE DRAWINGS

The structure and characteristics of the composite label of the invention will be more apparent from the description of one embodiment thereof given hereinafter by way of non-limiting example with reference to the accompanying drawing, wherein.

DETAILED DESCRIPTION OF THE PREFERRED EMBODIMENT

Figure 1:
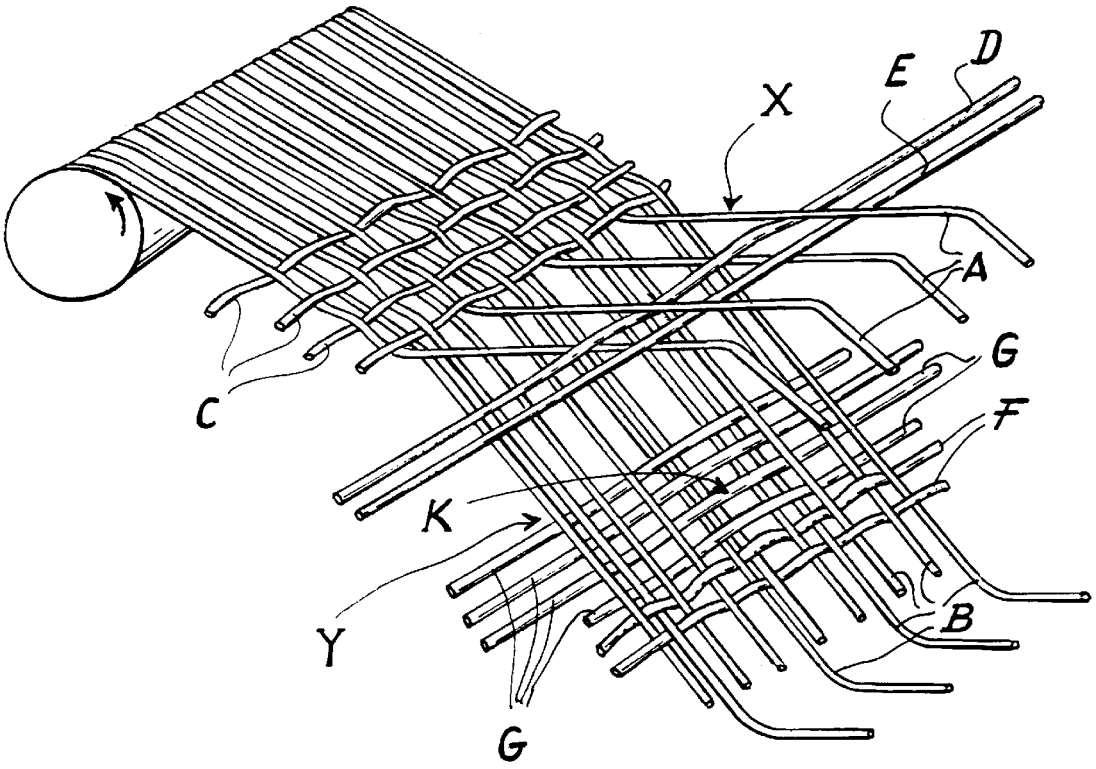
FIG. 1 is a schematic representation of a tubular double fabric shown during the weaving of the label.
Figure 2:
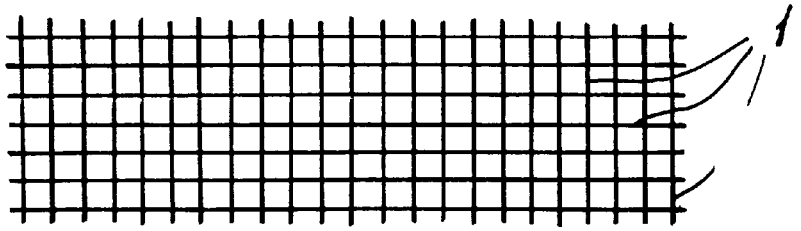
FIG. 2 is a front view of a mesh fabric 1, which is totally or partially formed from transparent yarns.
Figure 3:
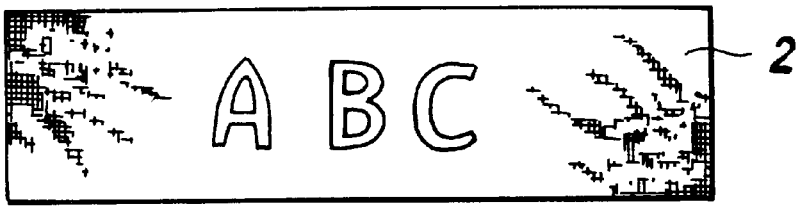
FIG. 3 is a front view of a fabric 2 formed from warp and weft yarns of different colours woven together in such a manner as to form an image or inscription (letters A, B, and C) on the face of the fabric.
Figure 4:
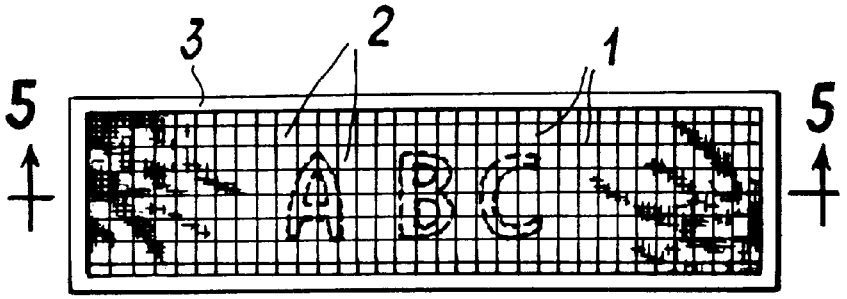
FIG. 4 is a front view of a woven label according to the present invention, wherein the mesh fabric 1 is superposed to the fabric 2 to which it is secured and joined along the edges 3 by thermal or ultrasound welding or by selvedged edges.
Figure 5:
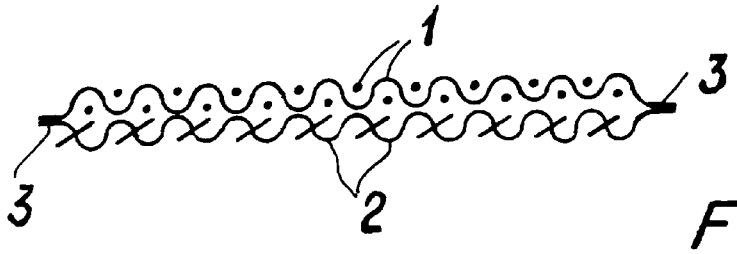
FIG. 5 is a side cross-sectional view of the woven label depicted in FIG. 4.

To understand the structure of the transparent double fabric, a portion of which is shown on the drawing, it should be noted that this fabric is produced on a jacquard loom and is formed from upper warp yarns A and lower warp yarns B which are coplanar with each other and are bound by weft yarns C to form a single (ie single-layer) fabric in the upper part of the drawing, the warp yarns A then diverging from the yarns B in the central part of the drawing, where the yarns A are bound with yarns D of transparent polyamide (nylon) fibre constituting the background weft and respectively with yarns E of black polyester constituting the brocade weft of a mesh fabric X through which the fabric lying below it is visible.

Within the central region of the drawing, which represents the fabric formation region, the lower warp yarns B are bound with black polyester yarns F constituting the brocade weft of a fabric Y in which other mixed viscose polyester weft yarns G form (on that face of the fabric Y facing the mesh fabric X) an image or inscription K which is of steel colour well visible on the black brocade weft.

The two fabrics X and Y remain separated from each other above the region in which the image K is formed, after which the warp yarns A and B are again automatically brought side by side to form a single fabric bound by further weft yarns such as the yarns C shown schematically in the upper part of the drawing. The labels are subsequently cut automatically from the composite fabric ribbon obtained in this manner, and their edges fixed by a selvedge or welded thermally or by ultrasound.

The ease with which the tubular double fabric can be formed will be apparent from the ensuing description of two examples of their formation.

EXAMPLE 1

It will be assumed that a composite label is to be formed consisting of two separate fabrics superposed one on the other over their entire surface, the upper fabric consisting of a transparent mesh giving the label an appearance of depth and refraction enabling the image to be seen on the underlying fabric for which the mesh acts as a protective support.

A jacquard-controlled gripper loom with thermal cutting of a type well known in the art is used, in particular a loom manufactured and marketed by the firm Muller having a maximum utilization range of 100 mm. This loom was set for a centrimetric reduction of 93 yarns through the reed (ie 93 warp yarns pass for each cm of the piece), whereas 30 yarns per cm were used for the weft. However the centimetric reduction can be generally set from a minimum of 50 to a maximum of 120 yarns and can vary in the weft direction from a minimum of 25 to a maximum of 64.

The usable yarn counts can vary from 50 dtex to 200 dtex.

In the described example the warp was formed from a polyester fibre of 100 dtex count, 10 of the available 93 yarns per cm being used to form the mesh. To form the mesh fabric the warp yarns were woven with background weft yarns in the form of a polyamide (nylon) fibre having such transparency and resistance as to give the mesh fabric a shot effect.

To form the lower fabric the remaining 83 warp yarns (out of the total 93 used on the loom) were used, and can be woven with the weft using various weaves, in this specific case a twill on which yarns of different colour form the image or inscription which the label is to represent.

To produce the desired label a sketch of the label is firstly prepared, after which using a weaving program known by the name of Color-Jacq 4.40 scanning of the sketch is commenced, the design area is selected and is transported into the weaving program by converting the dimensions into yarns and wefts. This passage is recorded as "inserted plus program code name".

The label area is thus defined in yarns and wefts, the preceding insert is recalled and is positioned at the centre of the label area, memorizing it as "designing plus program code". The image or design is then stepped or cleaned up and the selvedge areas are positioned.

When the designing is finished, the command is set on the side for the colours (background plus brocades) and their succession sequence.

To produce the label of this example, transparent nylon yarns were used for the background weft, black polyester yarns of 70 dtex were used for the weft of the first and second brocade and steel-coloured mixed viscous polyester yarns of 200 dtex were used for the weft of the third brocade.

The background and brocade wefts are always woven with the warp. The nylon background weft is worked along the entire length of the label, alternating with the weft of the first black brocade in a ratio of 4:1 (4 wefts of nylon to one weft of the first black brocade) without applying the stop regulator command.

The first brocade is worked along the entire length of the label alternating with the nylon yarn in a ratio of 1:4 (1 weft of the first black brocade to 4 wefts of nylon). Both the nylon and the first brocade are woven with that warp remaining in the upper part of the label using a weave with a yarn:weft ratio of 20:2.

The second brocade is worked along the entire length of the label, woven with the warp in a twill weave.

The third brocade is worked within the area of the design with a heavy 24 weave bound behind the second brocade with a light 36 satin.

Having completed this operation, which defines the operating field for weft insertion, the multiple warp command is applied, and the warp is separated into two parts, namely warp A and warp B.

The warp A is worked in the upper part of the label to form the mesh fabric, not included on the designing, but by using the warp commands. It alternates with the warp B in a ratio of 1:9 (10 yarns:83 yarns per cm).

The warp B is worked in the lower part of the label and alternates with the warp A in a ratio of 9:1 (83 yarns:10 yarns per cm).

When the weft and warp commands have terminated their operation, the weave table is complied by inserting the weave codes into the weaving list which converts the design into the pattern card or into the weaving program.

In the aforedescribed manner a woven label is obtained which at the image K appears to be composed of two freely superposed fabrics joined together only at their periphery, but in reality consists of a single transparent textile product.

In the same manner and using the same loom, the label can be formed with the mesh fabric provided (separate from it) only at and above the the image or inscription on the first fabric, with the label achieving the same advantages and characteristics as if the mesh fabric extended over the entire label surface.

EXAMPLE 2

The loom described in Example 1 is utilized, but the weaving program used in that known by the name of MUCAD 1.32, starting by scanning the sketch and defining the scanner reading area. When the scanning has been memorized it is transferred to the weaving program, assigning it a code and inserting it into a warp plan (the label height), and assigning the beats per cm and the number of colours to be used. The scanning is then converted into designing and the weave table is complied in the same manner as that complied in the program of Example 1, but in this case the final result is obtained by combining the weaves of the various colours worked within the label in accordance with precise schemes, in that the weaves of the mesh fabric must be formed such that they never become interlaced with those of the underlying fabric, in order to maintain them separated.

What is claimed is:

1. A woven label for clothing, footwear, furnishings and the like, comprising:

a first fabric formed from warp and weft yarns of different colours woven together in such a manner as to form an image or inscription on one face of said first fabric; and a mesh fabric at least partially formed from transparent yarns and which is superposed on the first fabric to cover said image or inscription, at least portions of the first fabric and mesh fabric being secured to each other outside said image or inscription.

2. The woven label according to claim 1, wherein said mesh fabric is superposed on the entire surface of the first fabric, on that face of which said image is formed.

3. The woven label according to claim 1, wherein portions of said first fabric and said mesh fabric are interwoven at an area outside said image or inscription.

* * * * *